US008845383B2

(12) United States Patent
Schoen et al.

(10) Patent No.: US 8,845,383 B2
(45) Date of Patent: Sep. 30, 2014

(54) INTERCHANGEABLE STIMULATION SYSTEM FOR CHILD CARRIER

(75) Inventors: Macey D. Schoen, Las Vegas, NV (US); Katherine F. Richardson, Las Vegas, NV (US); Max R. Beach, Long Beach, CA (US); Jesus Galaz, Azusa, CA (US); Clint Woesner, Los Angeles, CA (US)

(73) Assignee: American Posterity LLC, Las Vegas, NV (US)

( * ) Notice: Subject to any disclaimer, the term of this patent is extended or adjusted under 35 U.S.C. 154(b) by 509 days.

(21) Appl. No.: 13/134,822

(22) Filed: Jun. 17, 2011

(65) Prior Publication Data

US 2011/0312243 A1 Dec. 22, 2011

Related U.S. Application Data

(60) Provisional application No. 61/397,918, filed on Jun. 18, 2010.

(51) Int. Cl.
*A63H 33/00* (2006.01)
*A47D 13/02* (2006.01)

(52) U.S. Cl.
CPC ..... *A47D 13/02* (2013.01); *A63H 33/006* (2013.01)
USPC ..... 446/227; 297/184.13; 297/219.12

(58) Field of Classification Search
CPC ..... A63H 33/006; A63H 33/42; A47D 13/10; A47D 13/063
USPC ..... 446/227; 297/184.13, 219.12
See application file for complete search history.

(56) References Cited

U.S. PATENT DOCUMENTS

| | | | | |
|---|---|---|---|---|
| 2,883,678 | A * | 4/1959 | Heffernan et al. | 5/93.1 |
| 3,828,888 | A | 8/1974 | Gottschalk | |
| 4,540,219 | A * | 9/1985 | Klinger | 297/487 |
| 4,785,838 | A | 11/1988 | Negahdari | |
| 4,913,463 | A | 4/1990 | Tlapek et al. | |
| 4,939,582 | A * | 7/1990 | Holdredge et al. | 348/836 |
| 5,007,674 | A | 4/1991 | Franc | |
| 5,195,918 | A | 3/1993 | Mozes | |
| 5,634,796 | A | 6/1997 | Dollar | |
| 5,730,490 | A | 3/1998 | Mortenson | |
| 5,882,208 | A | 3/1999 | Fulop | |

(Continued)

FOREIGN PATENT DOCUMENTS

| | | |
|---|---|---|
| EP | 1679105 | 7/2006 |

OTHER PUBLICATIONS

Lewis, Terri L. and Daphne Maurer. "Effects of Early Pattern Deprivation on Visual Development." Optometry and Vision Science. 2009. vol. 86, No. 6. pp. 640-649.

(Continued)

*Primary Examiner* — Gene Kim
*Assistant Examiner* — Joseph B Baldori
(74) *Attorney, Agent, or Firm* — Whiteford, Taylor & Preston, LLP; Gregory M. Stone

(57) ABSTRACT

Disclosed is an interchangeable stimulation system for child carriers that integrates an easily interchangeable stimulation device with a child carrier, such as a car seat, a carriage or stroller, a child swing, a crib, a playpen, or other child carrying device. The interchangeability of the system allows for display of stimulation devices that are particularly configured to stimulate children that are within distinct, defined age groups without requiring replacement of the stimulation system.

21 Claims, 12 Drawing Sheets

(56) References Cited

U.S. PATENT DOCUMENTS

| | | | | |
|---|---|---|---|---|
| 6,039,393 | A * | 3/2000 | Roh | 297/184.13 |
| 6,113,454 | A | 9/2000 | Mitchell | |
| 6,129,416 | A | 10/2000 | Bowen et al. | |
| 6,155,628 | A | 12/2000 | Williams | |
| 6,183,335 | B1 * | 2/2001 | Petersen | 446/227 |
| 6,517,153 | B1 * | 2/2003 | Brewer | 297/184.13 |
| 6,574,812 | B2 * | 6/2003 | Jakubowski et al. | 5/658 |
| 6,682,389 | B2 * | 1/2004 | Wells | 446/227 |
| 6,764,133 | B2 | 7/2004 | Osato | |
| 6,848,966 | B2 | 2/2005 | Wells | |
| 7,150,499 | B2 | 12/2006 | McGregor | |
| 7,185,694 | B2 | 3/2007 | Dunn et al. | |
| 7,487,979 | B2 * | 2/2009 | Ferraioli | 280/47.38 |
| 7,727,078 | B2 * | 6/2010 | Arnold et al. | 472/118 |
| 2004/0119266 | A1 * | 6/2004 | Ulrich | 280/642 |
| 2006/0119144 | A1 | 6/2006 | Alexakis | |
| 2007/0257526 | A1 | 11/2007 | Hei et al. | |
| 2007/0278756 | A1 * | 12/2007 | Erskine | 280/47.25 |
| 2008/0042384 | A1 | 2/2008 | Ferraioli | |
| 2008/0143155 | A1 | 6/2008 | Arnold et al. | |
| 2012/0062001 | A1 * | 3/2012 | Krasley | 297/184.13 |

OTHER PUBLICATIONS

"Visual Stimulation for Newborns." Ask Dr. Sears—The Trusted Resource for Parents. http://www.askdrsears.com/topics/parenting/child-rearing-and-development/bright-starts-ba . . . Retrieved Mar. 3, 2014.

* cited by examiner

INTERCHANGEABLE STIMULATION SYSTEM FOR CHILD CARRIER

CROSS REFERENCE TO RELATED APPLICATION

This application is based upon and claims priority from U.S. Provisional Patent Application Ser. No. 61/397,918 entitled "Interchangeable Baby Shade," filed with the U.S. Patent and Trademark Office on Jun. 18, 2010 by the inventors herein, the specification of which is incorporated herein by reference.

FIELD OF THE INVENTION

This invention relates generally to interchangeable systems for stimulating a child through various stages of development, and more particularly to a system of one or more panels incorporating stimulation devices, which panels may be attached to child carriers of various configurations.

BACKGROUND OF THE INVENTION

Stimulation of developing infants and toddlers is considered to be quite important to a child's intellectual, physical, and emotional development. As a result, it is desirable to provide means by which an infant or toddler may be stimulated throughout daily life. For example, significant visual stimulation of infants has been considered helpful in aiding infants to develop vision faster than infants that are not exposed to large amounts of visual stimulation. Likewise, as a child develops over time, ongoing visual and other stimulation beyond the infancy stage through exposure to age-appropriate stimulation devices can have continuing benefits, such as helping the two or more month old start to distinguish colors and develop focus, helping the five or more month old develop concentration and enhance curiosity, keeping the older toddler entertained while travelling, as well as numerous other benefits.

A variety of child simulation devices have previously been provided, such as mobiles, flash cards, books, and the like, which may be targeted for a child of a specific age. For instance, very young infants' eyes are less able to distinguish fine pattern distinctions, such that large black and white patterns provided on such devices may be best to stimulate the early infant's vision. More developed infants and toddlers can more easily distinguish and comprehend color patterns and ultimately characters, common shapes, and other printed matter, such that more detailed visual stimuli are more appropriate at these more advanced stages of development. Thus, while such devices may have varied visual content that may be stimulating to children of various ages and at various stages of development, their physical configurations vary tremendously, and not all such physical configurations will be appropriate for children at all stages of development. Thus, it would be desirable to provide such a stimulating arrangement in a configuration capable of both being usable with a variety of child equipment (e.g., capable of use with child carriers of various forms), and of being modified to vary the visual stimulation presented to the child so as to adapt the visual stimulation to the child's stages of development over time.

For instance, when using a child carrier of any form, such as a car seat, a carriage or stroller, a child swing, a crib, a playpen, or other child carrying device, it would be beneficial to provide a device having a physical configuration capable of application to the various types of child carriers that a parent might wish to use, and that was likewise capable of modification with minimal effort to adapt the particular stimulating device to the child's current stage of development.

Likewise, for many such child carriers, a parent may wish to shade at least a portion of the compartment holding the child so as to protect the child from wind, rain, and excessive sunlight. However, the configurations of prior known shade hoods on strollers, car seats, and other child carriers would typically make integration of an easily replaceable stimulating device quite difficult, and likewise would typically do nothing itself to aid in stimulating the child in such carrier. Thus, so as to maximize the opportunity to stimulate the child in the child carrier while maintaining the ability to easily adapt a stimulating device to the child's current stage of development, it would be further advantageous to provide a stimulating device that integrates a shade hood, and particularly which shade hood itself further provides additional stimulation to the child.

SUMMARY OF THE INVENTION

Disclosed is an interchangeable stimulation system for child carriers that integrates an easily interchangeable stimulation device with a child carrier, such as a car seat, a carriage or stroller, a child swing, a crib, a playpen, or other child carrying device. The interchangeability of the system allows for display of stimulation devices that are particularly configured to stimulate children that are within distinct, defined age groups without requiring replacement of the stimulation system.

With regard to particular aspects of an embodiment of the invention, an interchangeable stimulation system for a child carrier is disclosed comprising a removably insertable panel having a first panel side and a second panel side opposite the first panel side, the first panel side having a first panel stimulation device positioned thereon so that the first panel stimulation device is viewable by an occupant of a child carrier when the panel is attached to the carrier, and wherein the first panel stimulation device is particularly configured to stimulate individuals in a first defined age group and is selected from a group of stimulation devices each of which is particularly configured to stimulate individuals in one of a plurality of distinctly defined age groups; and a liner having a first liner side and a second liner side opposite the first liner side, wherein the first liner side is configured for removable attachment to the second panel side, and wherein the second liner side is configured for attachment to a canopy on the carrier.

With regard to further aspects of an embodiment of the invention, a stimulation system for a child carrier is disclosed comprising a panel configured for attachment to an underside of a canopy of a child carrier, the panel having a first panel side and a second panel side opposite the first panel side, the first panel side having a first panel stimulation device positioned thereon so that the first panel stimulation device is viewable by an occupant of the carrier when the panel is attached to the carrier, wherein the first panel stimulation device is particularly configured to stimulate individuals in a first defined age group and is selected from a group of stimulation devices each of which is particularly configured to stimulate individuals in one of a plurality of distinctly defined age groups; and a shade hood attached to the panel and extensible from the panel, the shade hood being configured to cover a portion of the carrier that is not covered by a canopy of the carrier, and the shade hood having a first hood side and a second hood side opposite the first hood side, the first hood side having a first hood stimulation device positioned thereon so that the first hood stimulation device is viewable by an occupant of the carrier when the first panel stimulation device is viewable by the occupant, and wherein the first hood stimulation device is particularly configured to stimulate individuals in the first defined age group.

With regard to still further aspects of an embodiment of the invention, an interchangeable stimulation system for stimulating a child through various stages of development is disclosed, comprising a panel configured for attachment to an underside of a canopy of a child carrier, the panel having a first panel face and a second panel face; wherein the first panel face comprises a first panel stimulation device positioned so that the first panel stimulation device is viewable by an occupant of the carrier, and wherein the first panel stimulation device is particularly configured to stimulate individuals in a first defined age group and is selected from a group of stimulation devices that are effective to stimulate individuals in one of a plurality of distinctly defined age groups; and wherein the second panel face comprises a second panel stimulation device positioned so that the second panel stimulation device is not viewable by an occupant of the carrier when the first panel stimulation device is viewable by an occupant of the carrier, and wherein the second panel stimulation device is particularly configured to stimulate individuals in a second defined age group and is selected from a group of stimulation devices that are effective to stimulate individuals in one of a plurality of distinct age groups.

BRIEF DESCRIPTION OF THE DRAWINGS

The numerous advantages of the present invention may be better understood by those skilled in the art by reference to the accompanying figures in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Disclosed herein is an interchangeable stimulation system for child carriers, including a car seat, a carriage or stroller, a child swing, a crib, a playpen, or other child carrying device. A panel is configured for removable attachment to a child carrier that presents a stimulation device, such as a visually stimulating pattern, to a child positioned in the carrier. As the panel is interchangeable, it may be used to provide the child with educational and/or entertainment content to stimulate their development throughout all levels of development beginning with infancy.

Figure 2:
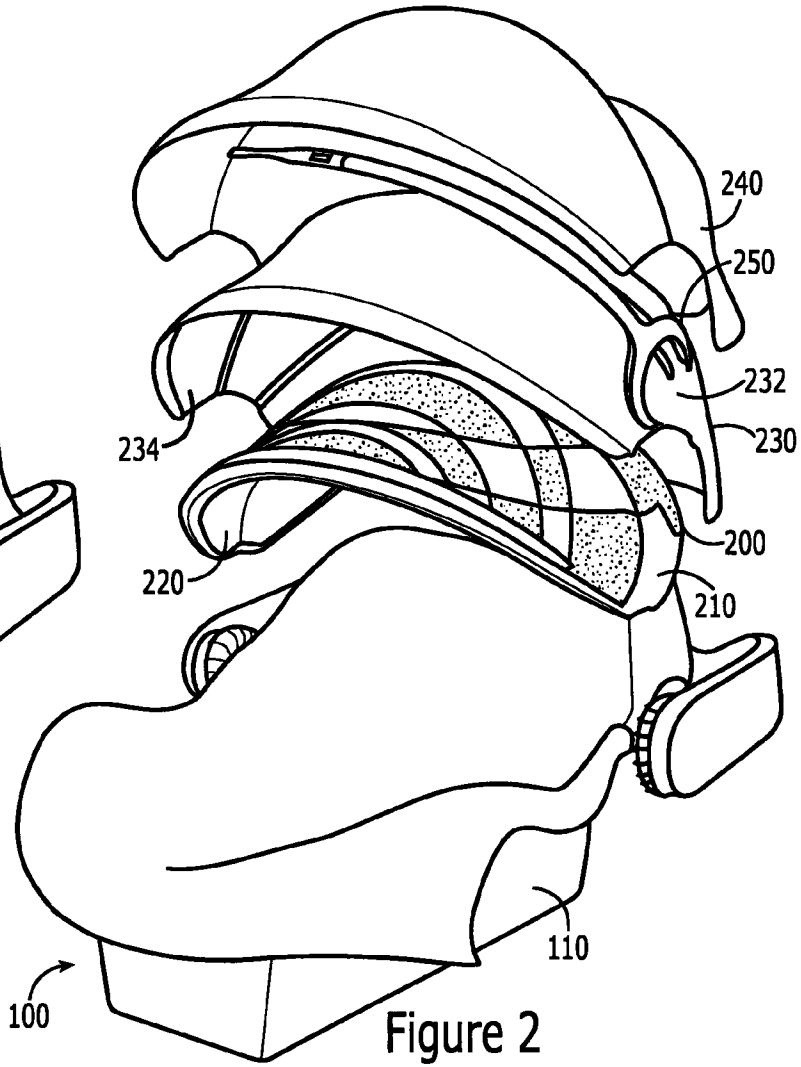
FIG. 2 is an exploded view of the child carrier of FIG. 1.
Figure 1:
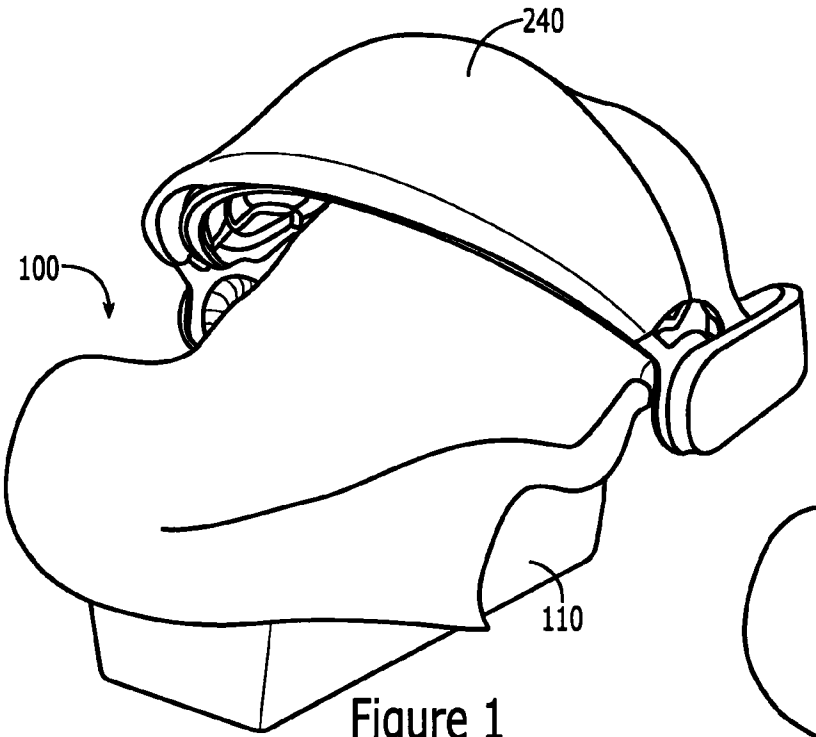
FIG. 1 is a perspective view of a child carrier incorporating a stimulation system in accordance with certain aspects of an embodiment of the invention.

FIG. 1 is a perspective assembled view and FIG. 2 is an exploded perspective view of an exemplary child carrier 100 exhibiting certain aspects of a particularly preferred embodiment of the invention. As shown in FIGS. 1 and 2, the child carrier 100 includes a carrier portion 110 of traditional configuration having, for instance, a well for cradling a child such that the child is generally facing and looking upward when positioned in the carrier. In a traditional child carrier 100, a canopy 240 is provided and is formed of a flexible material that may be unfolded so as to shade the infant when positioned within carrier portion 110, and that may be folded rearward towards the back of carrier portion 110 when such shade is not desired. The canopy 240 assembly typically includes a semi-rigid or rigid arm 250 extending through a front seam of canopy 240 so as to maintain the desired shape for the front edge of canopy 240. The arm 250 is typically provided a coupling allowing its removable attachment to a portion of the carrier portion 110, such as by being joined to the handle attachment for the carrier portion 110.

With regard to a particular aspect of a preferred embodiment of the invention, a panel 200 is provided and configured for removable attachment to the underside of canopy 250 so as to position the panel 200 directly in the field of view of an infant cradled in carrier portion 110 when the canopy 240 is deployed. Panel 200 has a top side 210 and a bottom side 220. At a minimum, bottom side 220 of panel 200 is provided a stimulation device that is particularly configured to stimulate individuals within a defined age group. For example, the stimulation device may comprise a visually stimulating pattern that is viewable by the child when positioned within the carrier portion 110, which stimulating pattern may comprise large black and white geometric shapes for very young infants, or more complex and colorful patterns for slightly more mature infants, or even more complex themed or character-based images and content for toddlers. Optionally, top side 210 of panel 200 may be provided an alternate visually simulating pattern, such that the pattern presented to the child may be varied without requiring the replacement of the entire panel 200. In this case, the alternate visually stimulating pattern on top side 210 of panel 200 may be configured to stimulate individuals in the same age group as the pattern on bottom side 220, or may alternatively be configured to stimulate individuals in a distinct age group from that of bottom side 220.

With particular regard to FIG. 2, in order to facilitate the attachment of panel 200 to the canopy 240, a liner 230 may also be provided, which liner 230 may be attached directly to the underside of outer canopy 240. For instance, liner 230 may be permanently attached to the underside of canopy 240 by applying adhesive or the like to the top side 232 of liner 230, or alternatively by sewing liner 230 directly to the underside of canopy 240. Alternatively, liner 230 may be removably attached to the underside of canopy 240, such as by use of snaps, buttons, hook and loop fastening material, or the like. Those of ordinary skill in the art will recognize that other means of attachment of liner 230 to the underside of canopy 240 may likewise be used without departing from the spirit and scope of the invention.

While all such components may be formed of machine washable polyester or cotton/polyester blends, those of ordinary skill in the art will recognize that any preferably child-safe flexible materials could be used for such components without departing from the spirit and scope of the invention.

Underside 234 of liner 230 is preferably provided a fastening system to removably receive panel 200. For instance, mating sections of hook and loop fastening material may be provided on the underside 234 of liner 230 and on a top side 210 of visually stimulating panel 200 to allow the two to be removably attached to one another. Similarly, snaps, buttons, and other similarly configured fasteners may likewise be used to removably attach visually stimulating panel 200 to liner 230 without departing from the spirit and scope of the invention.

Figure 3:
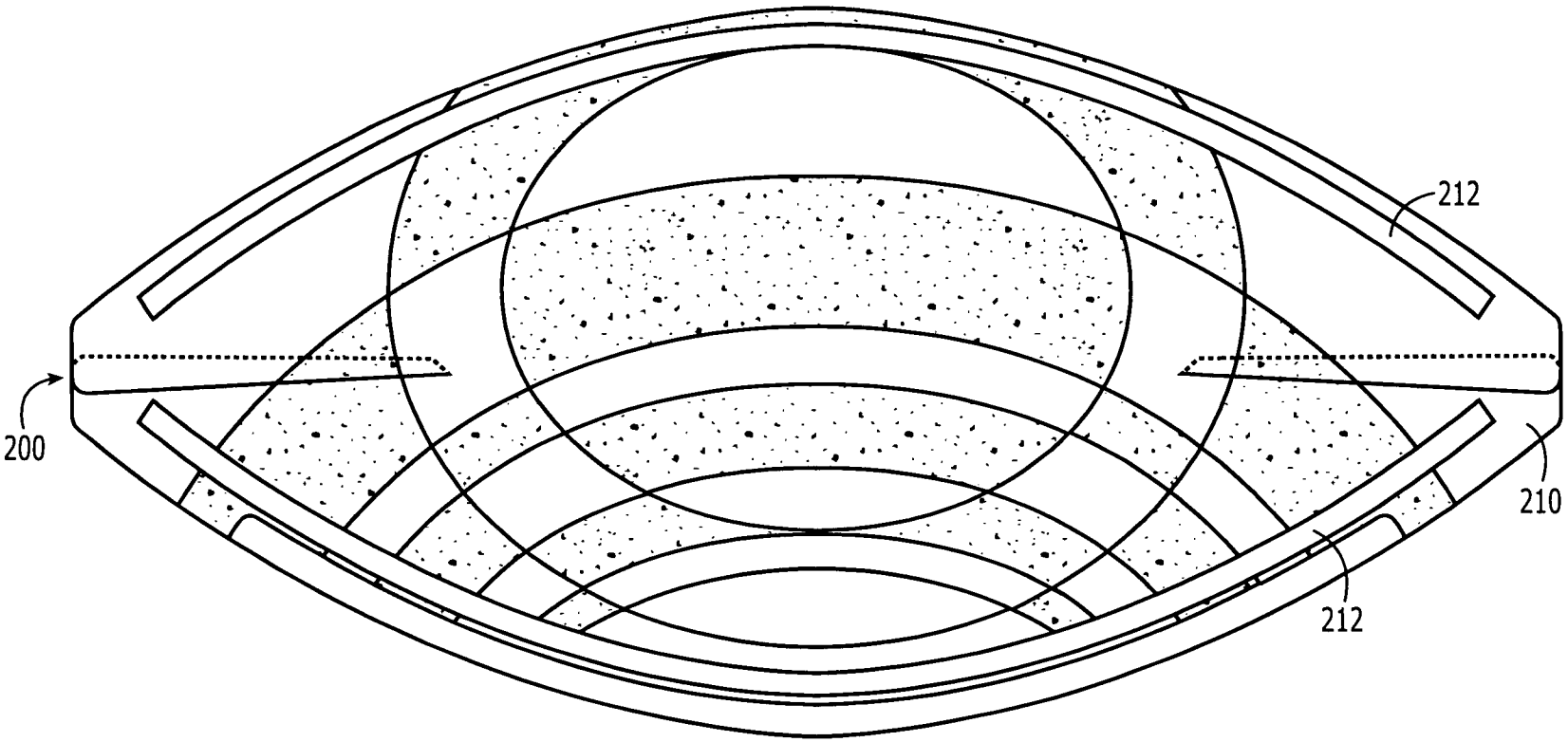
FIG. 3 is a bottom view of a panel incorporating a stimulating device in accordance with certain aspects of an embodiment of the invention.

As shown in FIG. 3, a reversible visually stimulating panel 200 may be provided, in which case varied designs may be provided on the top side 210 (visible in FIG. 3) and on the bottom side 220 (not shown in FIG. 3). In this configuration, strips 212 of hook and loop fastening material are preferably provided along upper and lower long edges of both the top side 210 and bottom side 220 of panel 200, which strips 212 of hook and loop fastening material are configured to align and mate with complementary sections of hook and loop fastening material positioned on the underside 234 of liner 230.

Those of ordinary skill in the art will recognize that the particular patterns shown in the drawing figures are exemplary only, and various patterns suitable to various stages of child development may be selected without departing from the spirit and scope of the invention. Those of ordinary skill in the art will also recognize that panel 200 need not be reversible, and instead may provide hook and loop fastening material on one side and a visually stimulating design on the opposite side, without departing from the spirit and scope of the invention.

Figure 4:
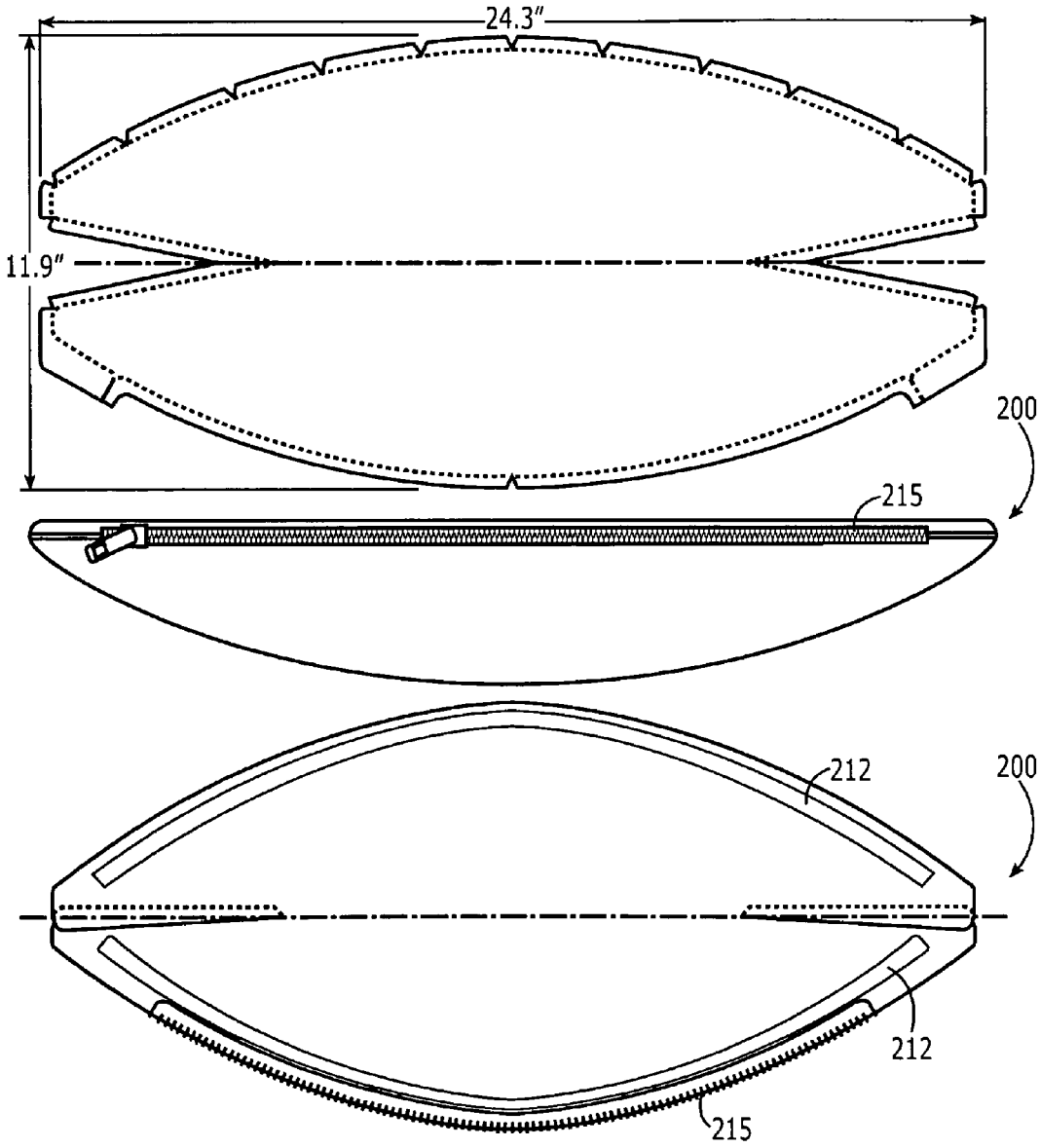
FIG. 4 is a schematic view of a pattern suitable for forming the panel of FIG. 3.

FIG. 4 provides a plan view of a pattern for forming panel 200, along with side and top views of the completed panel 200. As shown in the side view of panel 200 (shown in the middle of FIG. 4), the assembled panel 200 forms a generally convex cup so as to allow it to closely mate with the underside 234 of canopy 240 and/or liner 230.

Figure 5:
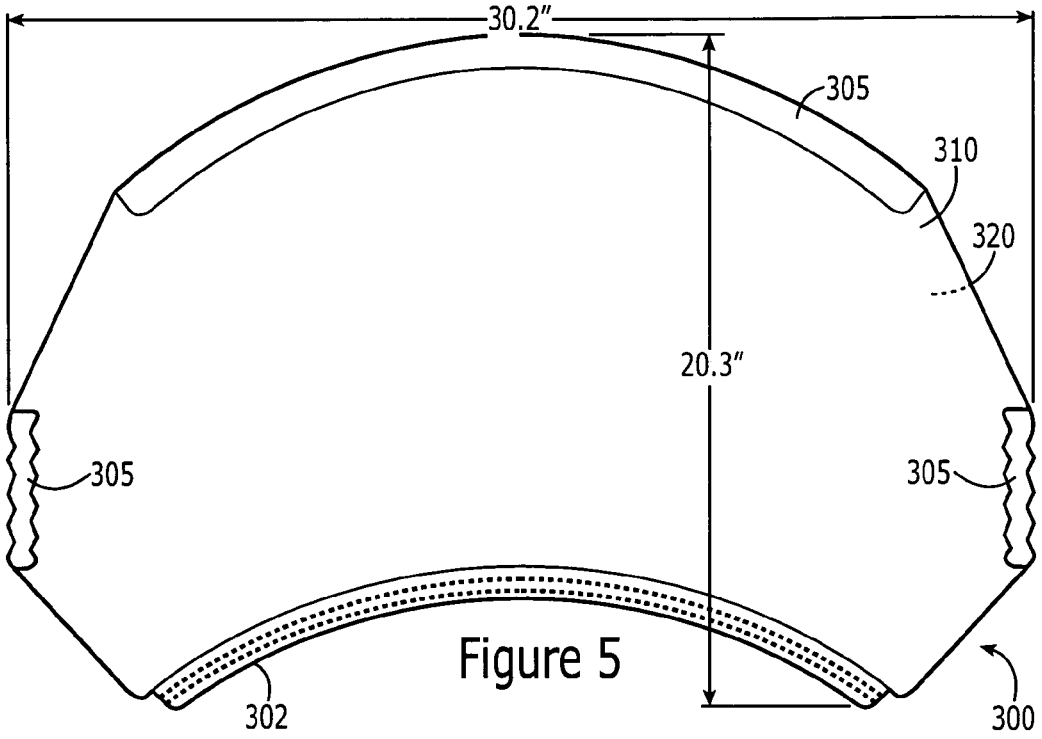
FIG. 5 is a schematic view of a pattern suitable for forming a shade hood for use with panel of FIG. 3.

Also shown in FIG. 4 is an optional zipper pocket 215 that may be provided along an edge of visually stimulating panel 200, which zipper pocket 215 may hold a visually stimulating shade hood 300, which is shown in FIG. 5. Shade hood 300 has a top side 310 and a bottom side 320, both of which may again be provided visually stimulating patterns. Moreover, the patterns are preferably configured to match or at least complement the associated patterns on panel 200. Thus, for instance, when panel 200 is positioned so as to present a pattern suited for early-stage infants, the pattern on shade hood 300 that is presented to the infant when the shade hood is deployed from zipper pocket 215 likewise is a pattern suited for early-stage infants. When panel 200 is reversed to display the alternate pattern to the infant, the opposite side of shade 300 will likewise be displayed to the infant and have a visually stimulating pattern that matches or complements the alternate pattern on panel 200.

Figure 6:
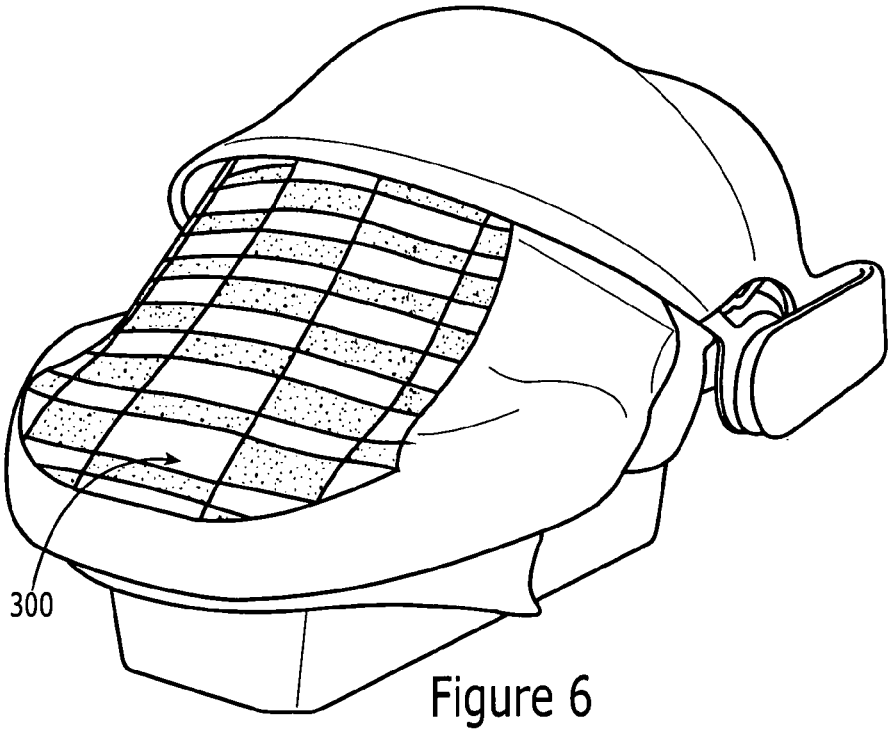
FIG. 6 is a perspective view of the child carrier of FIG. 1 further incorporating the shade hood of FIG. 5.

Shade 300 is preferably provided a seam 302 at one end where it may be stitched within zipper pocket 215 of panel 200, and is likewise preferably provided elastic bands 305 along edge portions of shade 300 to allow the edges of the shade to wrap around the edges of carrier portion 110 so as to removably hold shade 300 in place. FIG. 6 provides a perspective view of the shade 300 deployed with its edges wrapped around the edges of carrier portion 110.

While zipper pocket 215 is shown positioned along one edge of visually stimulating panel 200, those of ordinary skill in the art will also recognize that the position of such pocket and of hood 300 may be varied without departing from the spirit and scope of the invention, such as (by way of non-limiting example) positioning the zipper pocket at an alternative location on panel 200, or along an edge or other portion of canopy 240, or such other element as may be desirable for a particular application.

Figure 7:
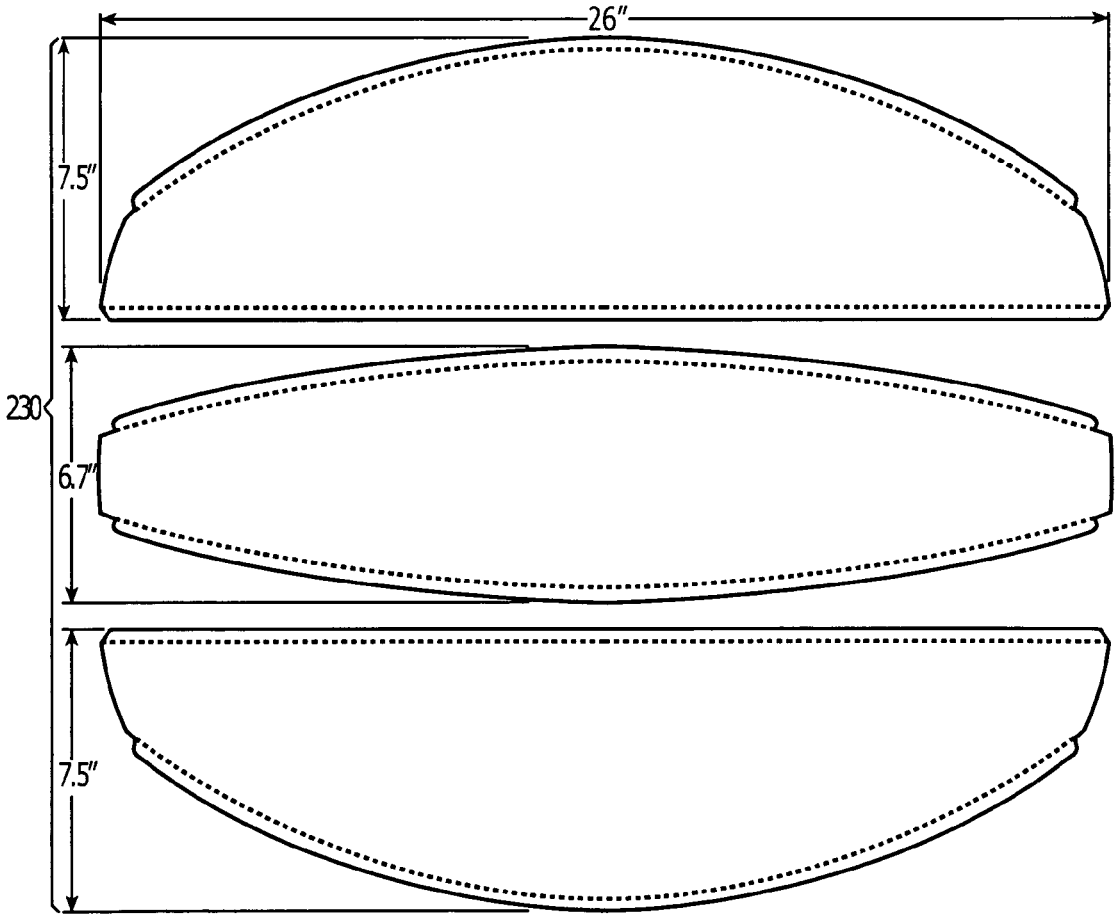
FIG. 7 is a schematic view of a pattern suitable for forming the liner of FIG. 2.

FIG. 7 provides an exemplary pattern that may be suitable for forming liner 230. While sections of hook and loop fastening material may be attached to the underside 234 of liner 230, alternatively the entire underside 234 of liner 230, or a significant portion of underside 234, may be formed of a first section of hook and loop fastening material, thus avoiding the need to precisely align the mating sections 212 of hook and loop fastening material on panel 200. Panel 200 is preferably configured so as to cover at least the fore and mid sections of liner 230 when installed, given the fact that the aft section of liner 230 would rarely be visible to the infant positioned within the carrier portion 110. Of course, those of ordinary skill in the art will also recognize that panel 200 may likewise cover the entire underside 234 of liner 230, or such other portion as may be desirable for a given application, without departing from the spirit and scope of the invention.

Figure 8:
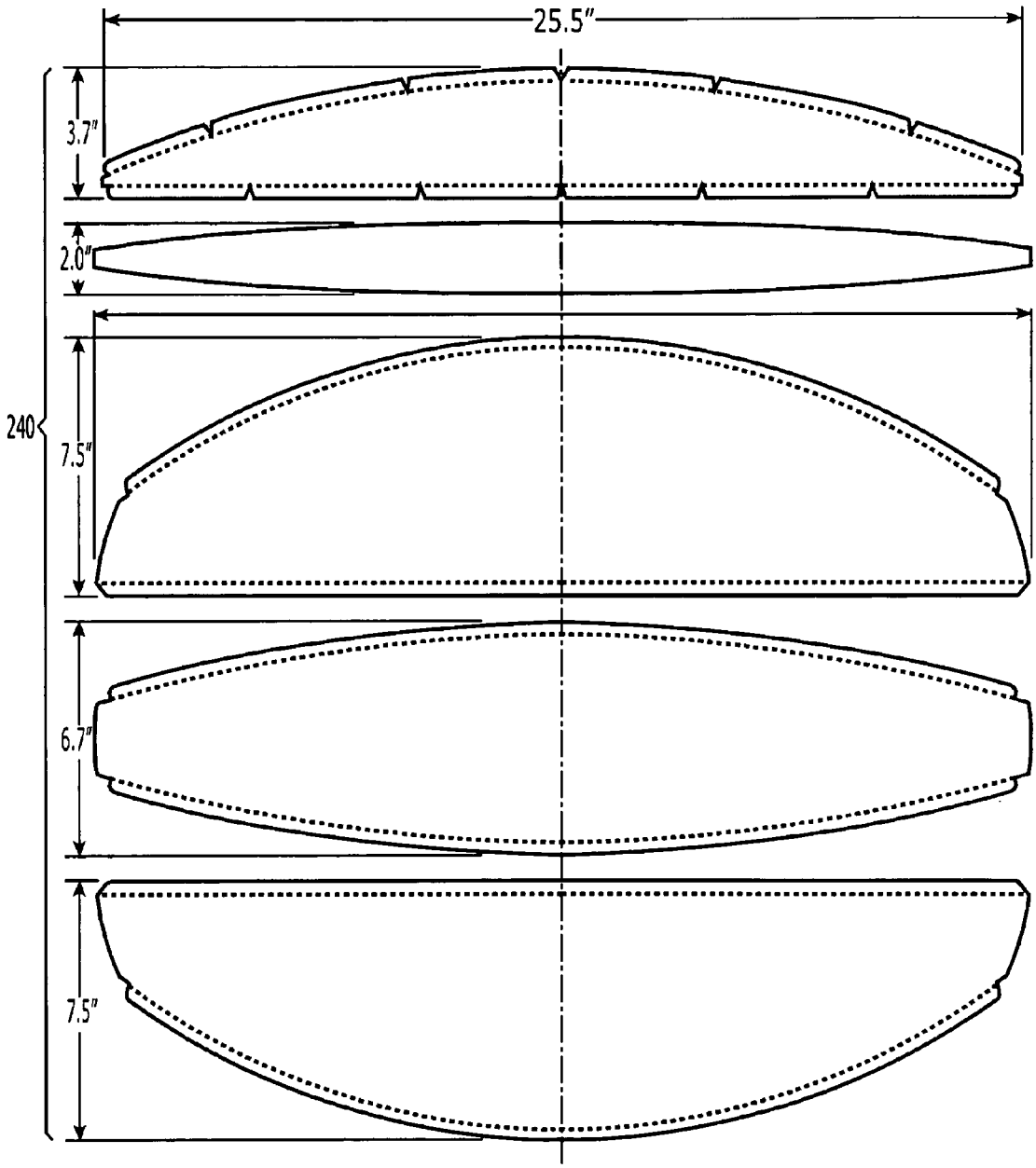
FIG. 8 is a schematic view of a pattern suitable for forming the canopy of FIG. 2.

Similarly, FIG. 8 provides an exemplary pattern that may be suitable for forming canopy 240. In one embodiment, canopy 240 and liner 230 may be provided as a single unit configured to replace an existing canopy on a child carrier.

Figure 9A:
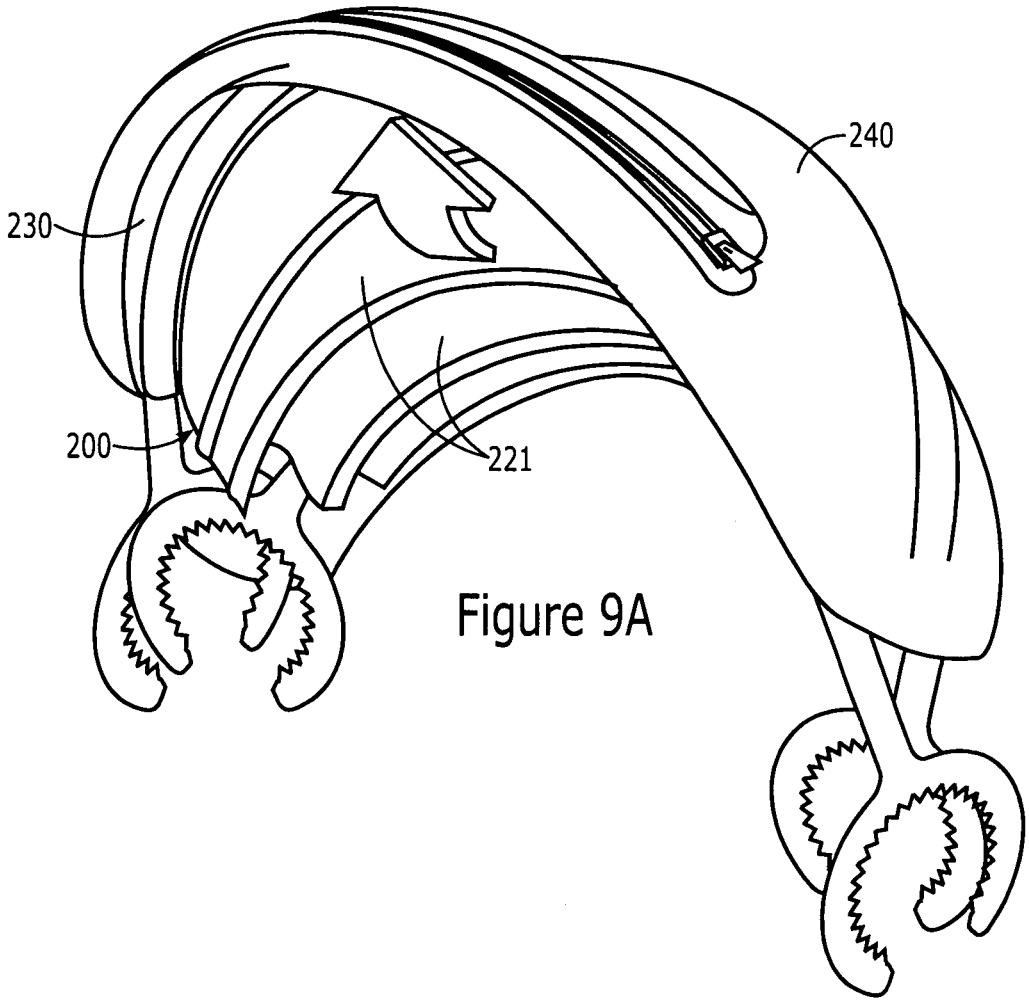
FIG. 9A is a perspective view of the stimulation system of FIG. 1 in accordance with further aspects of an embodiment of the invention.
Figure 9B:
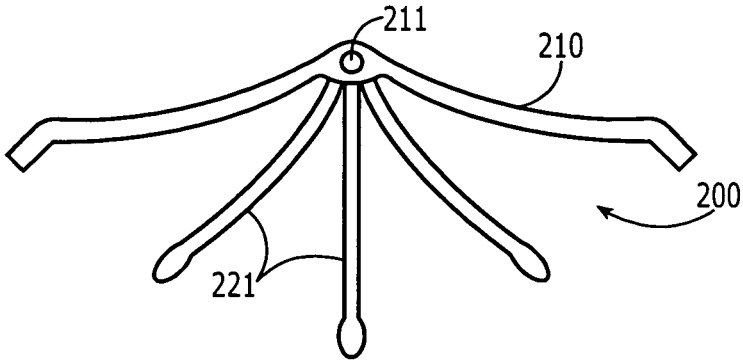
FIG. 9B is a side view of a panel used in the stimulation system of FIG. 9A.

As shown in FIGS. 9A and 9B, visually stimulating panel 200 may alternatively be configured in a multi-page, book-like configuration. In this case, top side 210 of panel 200 is again provided an attachment device, such as sections of hook and loop fastening material configured to mate with and removably attach to the underside of liner 230. Panel 200 may include a spine 211 containing a hinge that attaches multiple pages 221 of stimulating panel 200, with each child-facing pair of pages having complementary patterns, images, or other material different from the other pairs of pages, thus allowing the patterns that are presented to a child in carrier portion 110 to be varied simply by turning pages 221. In order to hold each of the pages 221 in place, the top and bottom outer edges of each page 221 are preferably provided mating sections of hook and loop fastening material allowing easy separation when the pages are desired to be turned, but securing the pages in place when a desired pattern has been selected.

Figure 10A:
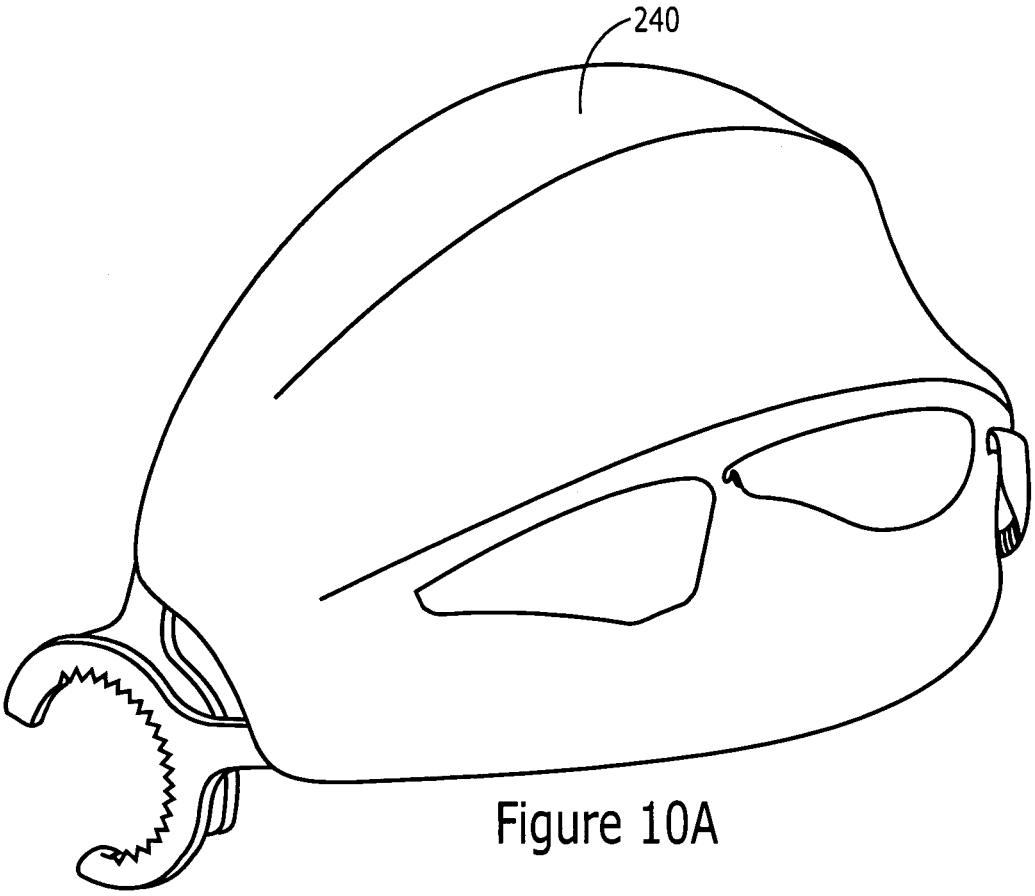
FIG. 10A is a perspective view of the canopy of FIG. 1 in accordance with further aspects of an embodiment of the invention.
Figure 10B:
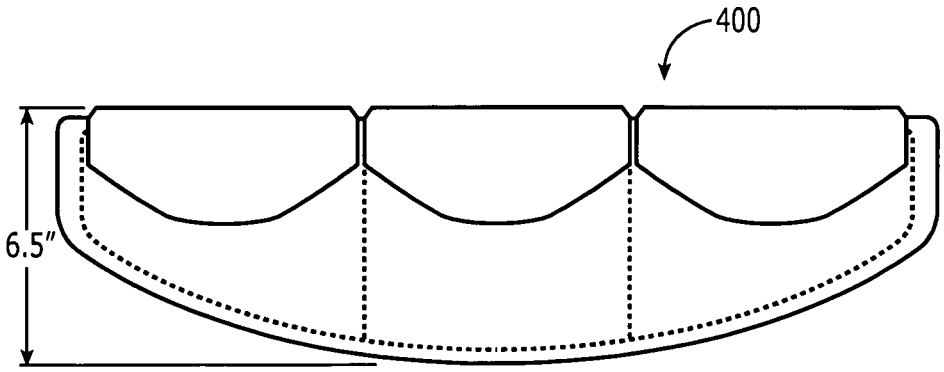
FIG. 10B is a rear view of a pocket assembly used with the canopy of FIG. 10A.
Figure 11A:
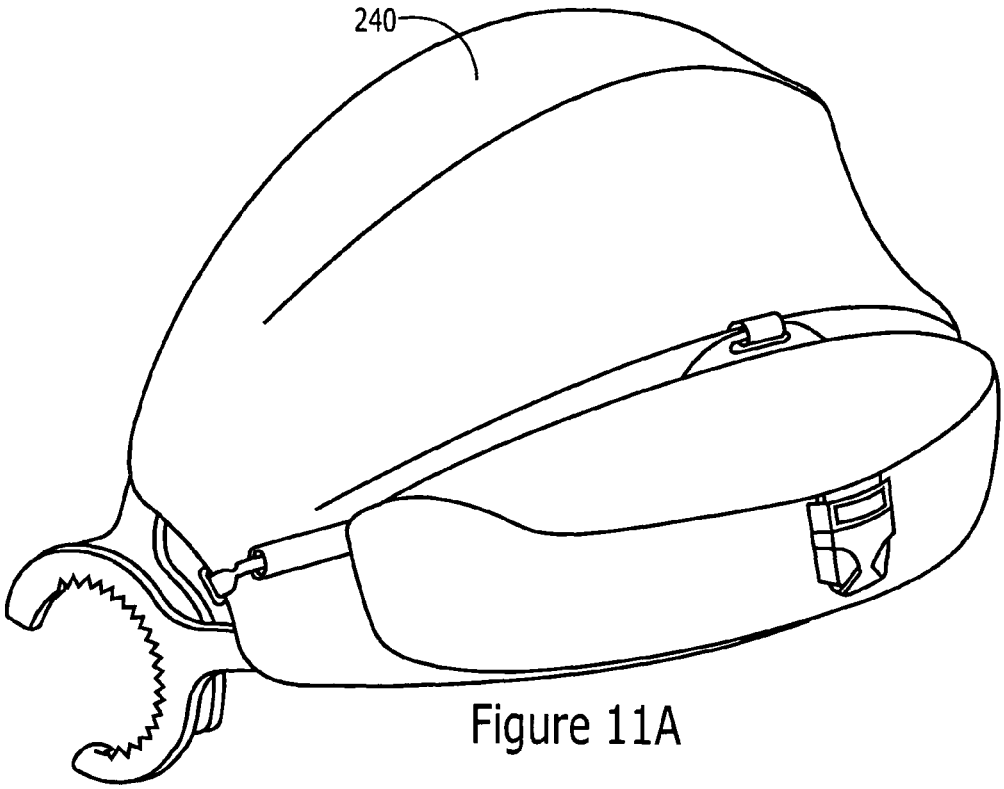
FIG. 11A is a perspective view of the canopy of FIG. 1 in accordance with further aspects of an embodiment of the invention.
Figure 11B:
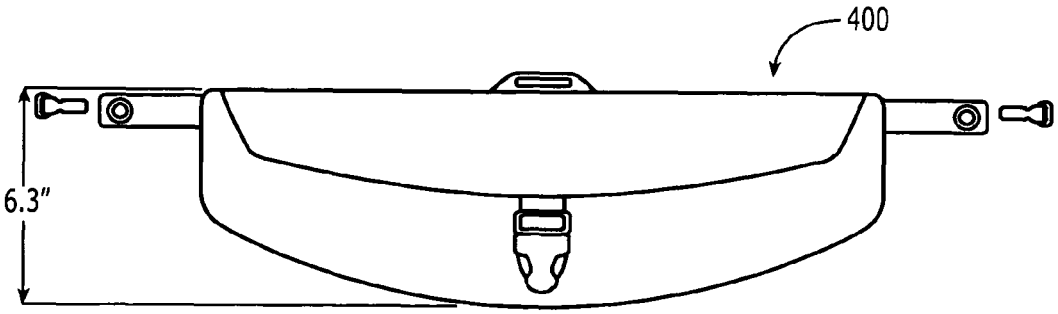
FIG. 11B is a rear view of a pocket assembly used with the canopy of FIG. 11A.
Figure 12A:
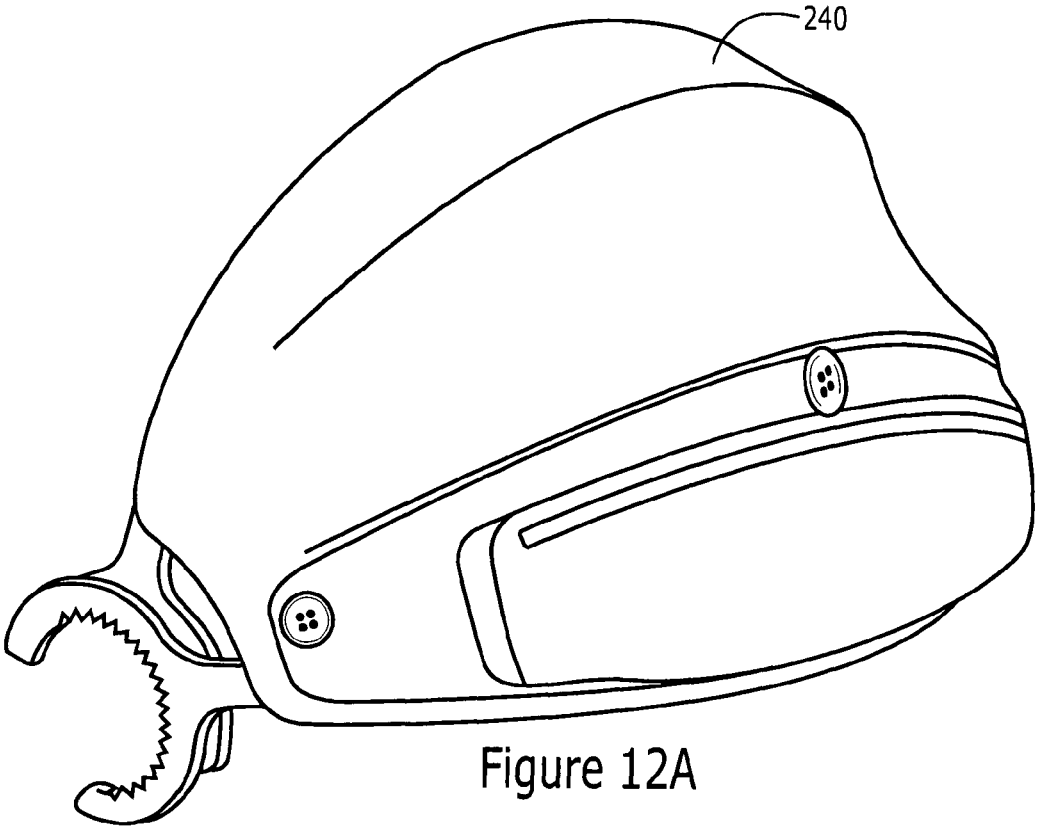
FIG. 12A is a perspective view of the canopy of FIG. 1 in accordance with further aspects of an embodiment of the invention.
Figure 12B:
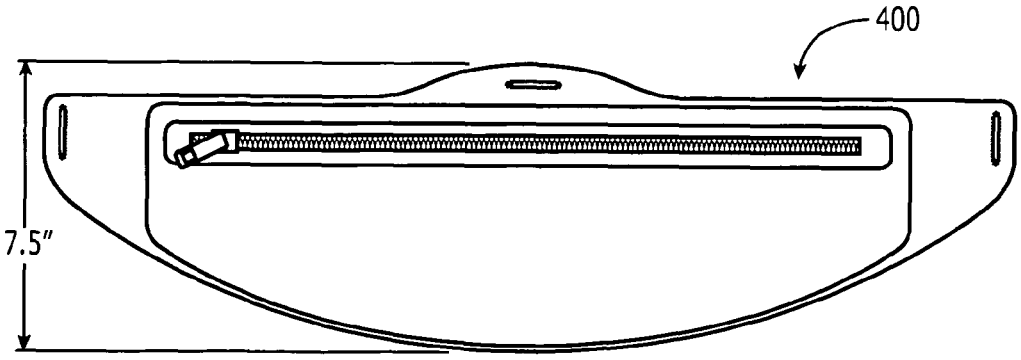
FIG. 12B is a rear view of a pocket assembly used with the canopy of FIG. 12A.

With regard to another aspect of an embodiment of the invention, and as shown in FIGS. 10-12, a storage pocket assembly 400 may optionally be provided and attached to the back, outer side of canopy 240 allowing for the convenient storage of various items. Storage pocket assembly may, by way of non-limiting example, comprise multiple pockets each having a flap closure (as shown in FIGS. 10A and 10B), or a single pocket having a single flap closure (as shown in FIGS. 11A, 11B, 12A and 12B). Moreover, the flap closures may be configured with various closures, such as by providing sections of hook and loop fastening material (as shown in FIGS. 10A and 10B), a snap closure (as shown in FIGS. 11A and 11B), a zipper closure (as shown in FIGS. 12A and 12B), or any variations of the foregoing. Still further, storage pocket assembly 400 may be joined to canopy 240 in various ways, such as by sewing or integrally forming the pocket assembly 400 with canopy 240 (as shown in FIGS. 10A and 10B), by attaching with hook and ring assemblies (as shown in FIGS. 11A and 11B), or by button attachment (as shown in FIGS. 12A and 12B). Those of ordinary skill in the art will recognize that other closure and attachment devices may likewise be used for closing the flap closures and attaching storage pocket assembly 400 to canopy 240 without departing from the spirit and scope of the invention.

Figure 13A:
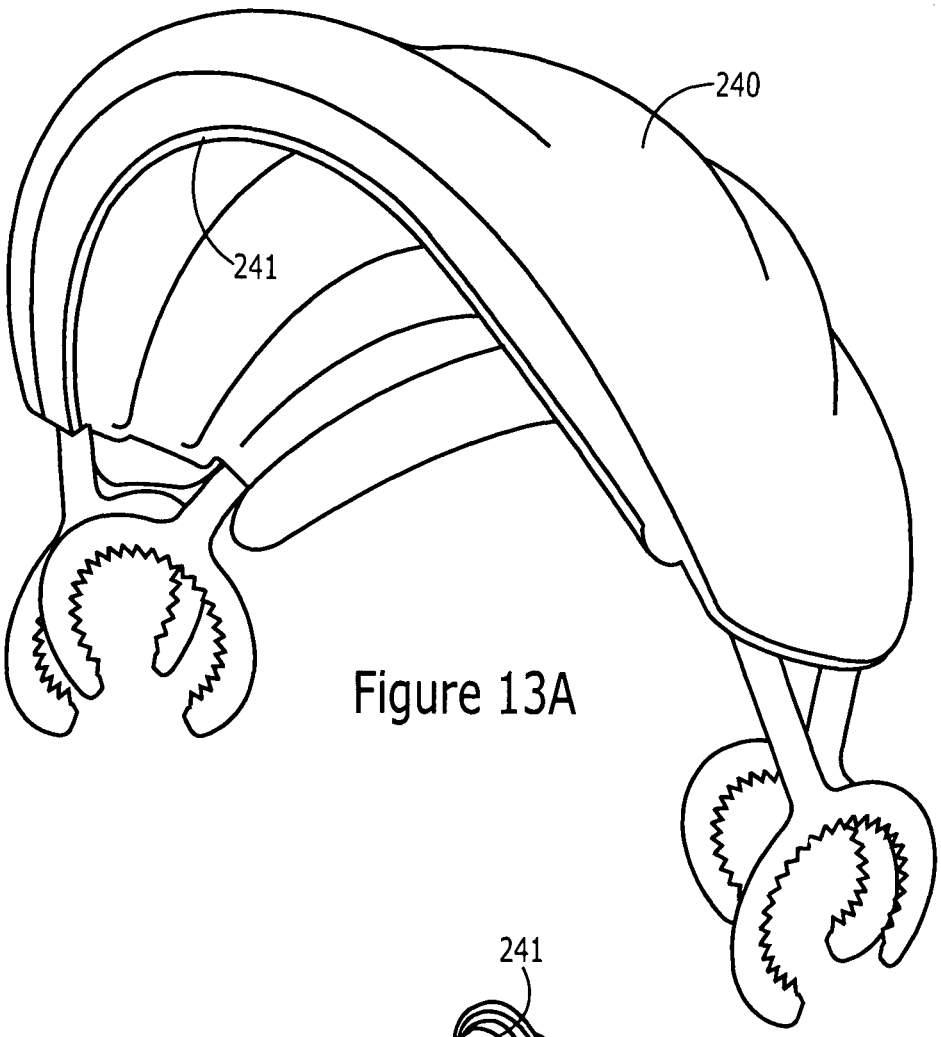
FIG. 13A is a perspective view and FIG. 13B is a side view of the canopy of FIG. 1 in accordance with further aspects of an embodiment of the invention.
Figure 13B:
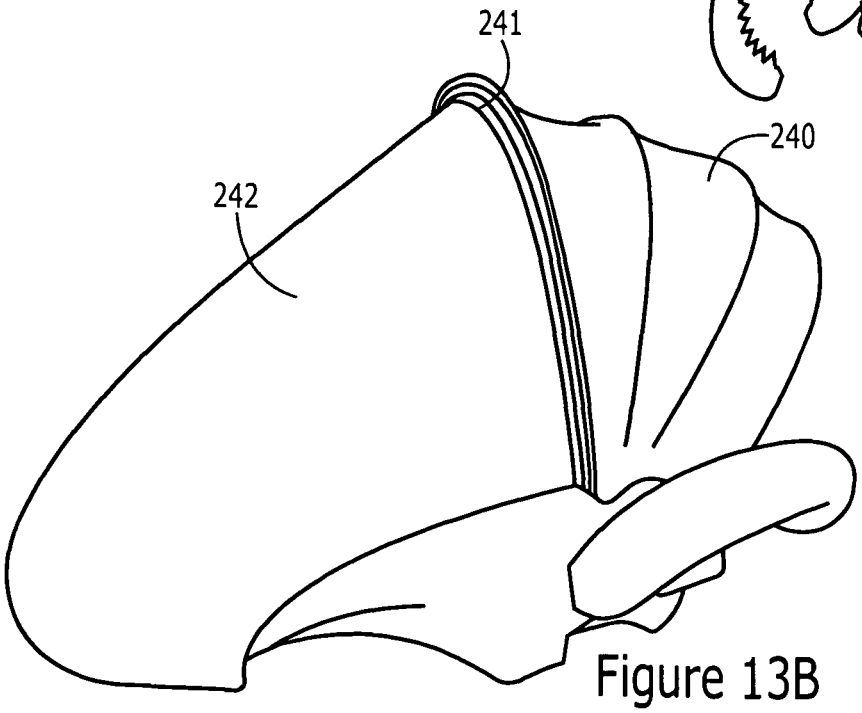
Figure 14:
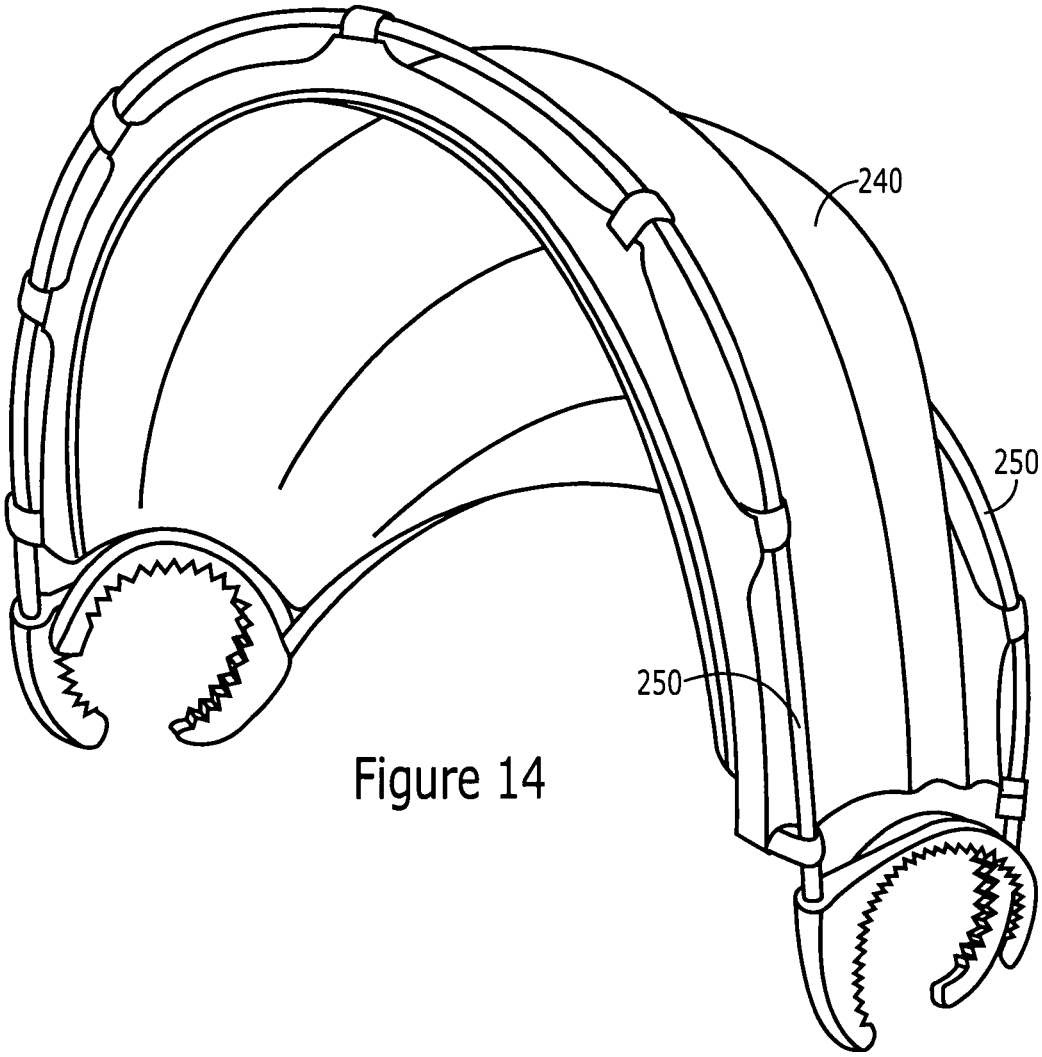
FIG. 14 is a perspective view of the canopy of FIG. 1 in accordance with further aspects of an embodiment of the invention.

Those of ordinary skill in the art will recognize that the particular dimensions of the elements shown in the drawing figures are exemplary only, and that such dimensions and shapes of various elements described herein may readily be varied to fit a particular carrier configuration or user's application without departing from the spirit and scope of the invention. Those of ordinary skill in the art will also recognize that other variations of the foregoing elements may likewise be made without departing from the spirit and scope of the invention. For instance, and by way of non-limiting example, in addition to or in place of zipper pocket 215 on visually stimulating insert 200, as shown in FIGS. 13A and 13B, canopy 240 may be provided a zipper pocket 241 from which may extend a shade hood 242 (configured similarly to shade hood 300 of FIGS. 5 and 6). Likewise, as shown in FIG. 14, various configurations may be provided for attaching canopy 240 to arms 250, which themselves may be variously configured (such as by attaching the edge of canopy 240 to clips that in turn attach to spans of arms 250, allowing replacement of the assembly when desired), without departing from the spirit and scope of the invention.

Further, while the exemplary figures have particularly presented a canopy cover for an infant carrier, those of ordinary skill in the art will likewise recognize that such assembly could readily be modified for adaptation to any child carrier, including by way of non-limiting example a car seat, a carriage or stroller, a child swing, a crib, a playpen, a pack-and-play, a baby gym, or similarly configured apparatus in which a child would be positioned for some extended length of time to view a visually stimulating panel as described herein. Likewise, other stimulating devices beyond static visually stimulating patterns could be provided to further enhance child development, comfort, and/or convenience, such as audio, visual, electronic, 3-dimensional, 2-dimensional, motion, or other sensory enhancement devices (tactile, palatable, etc.). Likewise, further devices may be integrated with child carriers that employ the invention described herein, such as devices used to enhance health benefits to the child, and/or devices that may enhance air flow and/or heating or cooling within the child carrier on which the invention is used, or other devices that might aid or enhance child safety, security, comfort, development, entertainment, and/or parental convenience.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

We claim:

1. An interchangeable stimulation system for a child carrier comprising:

a removably insertable panel having a first panel side and a second panel side opposite said first panel side;

said first panel side having a first panel stimulation device positioned thereon so that said first panel stimulation device is viewable by an occupant of a child carrier when said panel is attached to said carrier, wherein said first panel stimulation device further comprises a newborn response-inducing stimulation device having a newborn response-inducing visual stimulating pattern thereon;

said second panel side having a second panel stimulation device positioned thereon, wherein said second panel stimulation device is selected from the group of stimulation devices consisting of:

(i) a matured infant response-inducing stimulation device having a matured infant response-inducing visual stimulating pattern thereon, wherein said matured infant response-inducing visual stimulating pattern is more visually complex than said newborn response-inducing visual stimulating pattern; and (ii) a toddler response-inducing stimulation device having a toddler response-inducing visual stimulating pattern thereon, wherein said toddler response-inducing visual stimulating pattern is more visually complex than said matured infant response-inducing visual stimulating pattern; and a liner having a first liner side and a second liner side opposite said first liner side, wherein said first liner side is configured for removable attachment to each of said first panel side and said second panel side, and wherein said second liner side is configured for attachment to a canopy on said carrier.

2. The interchangeable stimulation device of claim 1, further comprising a hood attached to said panel and extensible from said panel, wherein said hood is configured to cover a portion of said carrier that is not covered by a canopy of said carrier.

3. The interchangeable stimulation device of claim 2, said hood having a first hood side and a second hood side opposite said first hood side, said first hood side having a first hood stimulation device positioned thereon so that said first hood stimulation device is viewable by an occupant of said carrier when said first panel stimulation device is viewable by said occupant, and wherein said first hood stimulation device further comprises a newborn response-inducing stimulation device having a newborn response-inducing visual stimulating pattern thereon.

4. The interchangeable stimulation device of claim 3, said second hood side having a second hood stimulation device positioned thereon, and wherein said second hood stimulation device is selected from said group of stimulation devices.

5. The interchangeable stimulation device of claim 1, said system further comprising a canopy having an inner canopy face attached to said second liner side of said liner, and an outer canopy face opposite said inner canopy face.

6. The interchangeable stimulation device of claim 5, further comprising a storage pocket on said outer canopy face.

7. The interchangeable stimulation device of claim 6, wherein said storage pocket is removably attached to said canopy.

8. A stimulation system for a child carrier comprising:

a panel configured for attachment to an underside of a canopy of a child carrier, said panel having a first panel side and a second panel side opposite said first panel side, wherein each of said first panel side and said second panel side includes an attachment device for removably attaching said panel to said canopy;

said first panel side having a first panel stimulation device positioned thereon so that said first panel stimulation device is viewable by an occupant of said carrier when said panel is attached to said carrier, wherein said first panel stimulation device further comprises a newborn response-inducing stimulation device having a newborn response-inducing visual stimulating pattern thereon;

said second panel side having a second panel stimulation device positioned thereon, wherein said second panel stimulation device is selected from the group of stimulation devices consisting of:

(i) a matured infant response-inducing stimulation device having a matured infant response-inducing visual stimulating pattern thereon, wherein said matured infant response-inducing visual stimulating pattern is more visually complex than said newborn response-inducing visual stimulating pattern; and (ii) a toddler response-inducing stimulation device having a toddler response-inducing visual stimulating pattern thereon, wherein said toddler response-inducing visual stimulating pattern is more visually complex than said matured infant response-inducing visual stimulating pattern; and a shade hood attached to said panel and extensible from said panel, said shade hood being configured to cover a portion of said carrier that is not covered by a canopy of said carrier both when said first side of said panel is attached to said canopy and when said second side of said panel is attached to said canopy, and said shade hood having a first hood side and a second hood side opposite said first hood side, said first hood side having a first hood stimulation device positioned thereon so that said first hood stimulation device is viewable by an occupant of said carrier when said first panel stimulation device is viewable by said occupant, and wherein said first hood stimulation device further comprises a newborn response-inducing stimulation device having a newborn response-inducing visual stimulating pattern thereon.

9. The stimulation system of claim 8, further comprising a liner having a first liner side and a second liner side opposite said first liner side, wherein said first liner side is configured for removable attachment to each of said first panel side and said second panel side, and wherein said second liner side is configured for attachment to a canopy on said carrier.

10. The stimulation system of claim 8, said second hood side having a second hood stimulation device positioned thereon, and wherein said second hood stimulation device is selected from said group of stimulation devices.

11. The stimulation system of claim 8, said system further comprising a canopy having an inner canopy face receiving said panel and an outer canopy face opposite said inner canopy face.

12. The stimulation system of claim 11, further comprising a storage pocket on said outer canopy face.

13. The stimulation system of claim 12, wherein said storage pocket is removably attached to said canopy.

14. An interchangeable stimulation system for stimulating a child through various stages of development comprising:

a panel configured for attachment to an underside of a canopy of a child carrier, said panel having a first panel face and a second panel face, wherein each of said first panel face and said second panel face includes an attachment device for removably attaching said panel to said canopy;

wherein said first panel face comprises a first panel stimulation device positioned so that said first panel stimulation device is viewable by an occupant of said carrier, and wherein said first panel stimulation device further comprises a newborn response-inducing stimulation device having a newborn response-inducing visual stimulating pattern thereon comprising black and white geometric shapes; and wherein said second panel face comprises a second panel stimulation device positioned so that said second panel stimulation device is not viewable by an occupant of said carrier when said first panel stimulation device is viewable by an occupant of said carrier, and wherein said second panel stimulation device is selected from the group of stimulation devices consisting of:

(i) a matured infant response-inducing stimulation device having a matured infant response-inducing visual stimulating pattern thereon comprising patterns formed of colors other than black and white, wherein said matured infant response-inducing visual stimulating pattern is more visually complex and colorful than said newborn response-inducing visual stimulating pattern; and (ii) a toddler response-inducing stimulation device having a toddler response-inducing visual stimulating pattern thereon comprising themed color images, wherein said toddler response-inducing visual stimulating pattern is more visually complex than said matured infant response-inducing visual stimulating pattern.

15. The interchangeable stimulation system of claim 14, further comprising a liner having a first liner side and a second liner side opposite said first liner side, wherein said first liner side is configured for removable attachment to each of said first panel side and said second panel face, and wherein said second liner side is configured for attachment to a canopy of said carrier.

16. The interchangeable stimulation system of claim 14, further comprising a hood attached to said panel and extensible from said panel, wherein said hood is configured to cover a portion of said carrier that is not covered by a canopy of said carrier.

17. The interchangeable stimulation system of claim 16, said hood having a first hood side and a second hood side opposite said first hood side, said first hood side having a first hood stimulation device positioned thereon so that said first hood stimulation device is viewable by an occupant of said carrier when said first panel stimulation device is viewable by said occupant, and wherein said first hood stimulation device further comprises a newborn response-inducing stimulation device having a newborn response-inducing visual stimulating pattern thereon.

18. The interchangeable stimulation system of claim 17, said second hood side having a second hood stimulation device positioned thereon, and wherein said second hood stimulation device is selected from said group of stimulation devices.

19. The interchangeable stimulation system of claim 14, said system further comprising a canopy having an inner canopy face receiving said panel and an outer canopy face opposite said inner canopy face.

20. The interchangeable stimulation system of claim 19, further comprising a storage pocket on said outer canopy face.

21. The interchangeable stimulation system of claim 20, wherein said storage pocket is removably attached to said canopy.

* * * * *